United States Patent [19]

Jensen

[11] 4,042,278

[45] Aug. 16, 1977

[54] DROWSING CHAIR PILLOW

[75] Inventor: Frank L. Jensen, Woods Cross, Utah

[73] Assignee: The Raymond Lee Organization, Inc., New York, N.Y. ; a part interest

[21] Appl. No.: 676,311

[22] Filed: Apr. 12, 1976

[51] Int. Cl.[2] ..... A47C 1/10

[52] U.S. Cl. ..... 297/397; 5/338; 297/403

[58] Field of Search ..... 297/397, 403, 391; 5/338

[56] References Cited

U.S. PATENT DOCUMENTS

| | | | |
|---|---|---|---|
| 2,582,571 | 1/1952 | Thoma | 297/397 |
| 2,591,306 | 4/1952 | Sherman | 297/397 |
| 2,908,766 | 10/1959 | Taylor | 297/391 |
| 3,017,221 | 1/1962 | Emery | 297/397 |

FOREIGN PATENT DOCUMENTS

| | | | |
|---|---|---|---|
| 225,872 | 7/1962 | Austria | 297/391 |
| 694,567 | 7/1953 | United Kingdom | 297/403 |

*Primary Examiner*—Roy D. Frazier
*Assistant Examiner*—Peter A. Aschenbrenner
*Attorney, Agent, or Firm*—Howard I. Podell

[57] ABSTRACT

A pillow unit that may be readily draped over the top of a chair back to enable a user to rest his head against the pillow for relaxation or drowsing purposes. The unit is formed of a flexible sheet of fabric material and fitted with one or more pairs of spaced pillow sections projecting from the face side of the fabric. Preferably the unit is formed with two pairs of pillow sections so that the fabric may be draped over the top of a chair back, with the pair of pillow sections of the fabric on the face side of the chair back balanced by the weight of the pair of pillow sections on the fabric lying on the back of the chair back.

1 Claim, 4 Drawing Figures

DROWSING CHAIR PILLOW

SUMMARY OF THE INVENTION

My invention is a pillow unit that may be readily draped over the top of a chair back to enable a user to rest his head against the pillow for relaxation of drowsing purposes. The unit is formed of a flexible sheet of fabric material and fitted with one or more pairs of spaced pillow sections projecting from the face side of the fabric. Preferably the unit is formed with two pairs of pillow sections so that the fabric may be draped over the top of a chair back, with the pair of pillow sections of the fabric on the face side of the chair back balanced by the weight of the pair of pillow sections on the fabric lying on the back of the chair back.

By means of my invention a person may readily rest his head between and against the spaced pillows of the unit mounted on a chair to comfortably relax or drowse.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
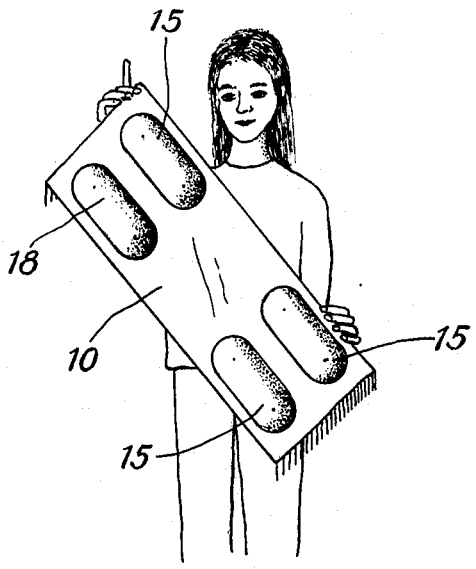
FIG. 1 is a perspective view of the invention.
Figure 2:
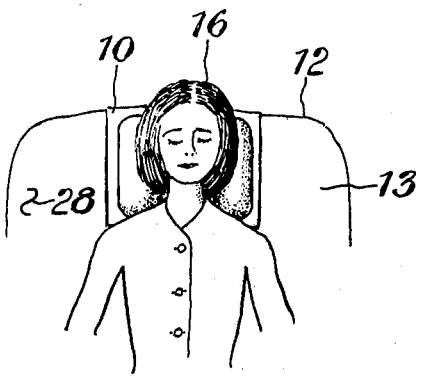
FIG. 2 is an elevation view of the invention in use.
Figure 3:
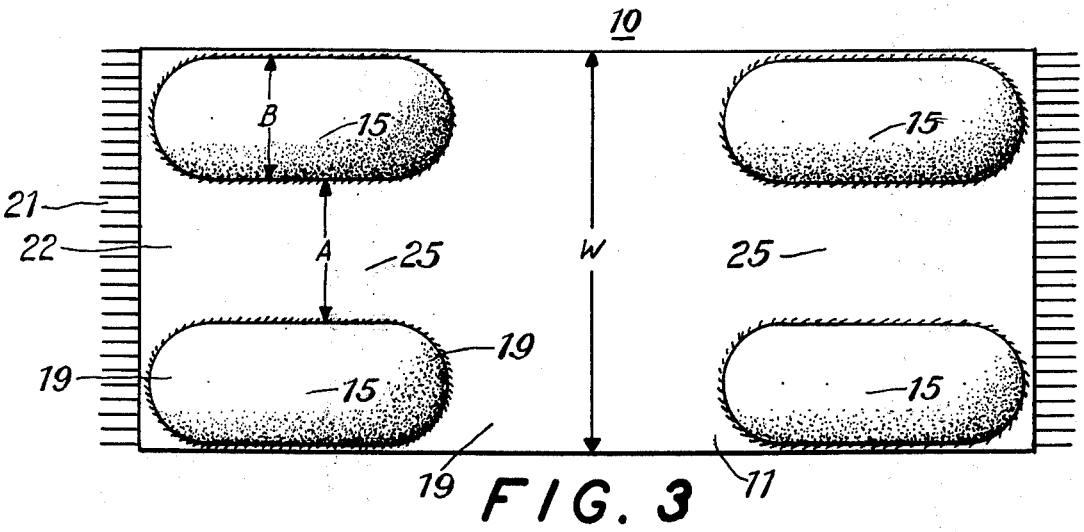
FIG. 3 is a plan view of the invention.
Figure 4:
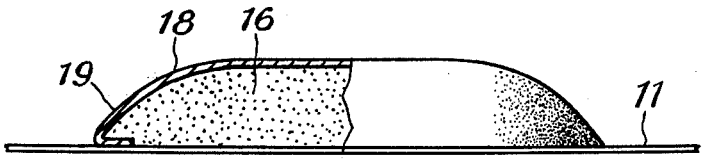
FIG. 4 is a sectional detail view of the invention.

Turning now descriptively to the drawings, in which similar reference characters denote similar elements throughout the several views, FIGS. 1–4 illustrate the chair pillow 10 which is in the form of a rectangular sheet 11 of flexible fabric material of a size to be draped over the back 12 of a chair 13 and fitted on the face side 14 of the sheet with one or more pairs of speced bolsters 15, with each of the bolsters 15 making up a pair spaced apart by a distance A of preferably 12.70 cm (5 inches) to provide room for the head 16 of a user to rest against both of a pair of bolsters 15 when the device is draped on the back 12 of a chair.

Each bolster 15 is formed of a stuffing 16 of foam rubber or plastic or similar padding, with the stuffing rising from the face side 14 of the fabric and covered by a cloth material 18, with the preferred shape of each bolster being of a generally semi-cylindrical form, the longitudinal axis of which is parallel to the longitudinal axis of the rectangular sheet 11, with the ends 19 of each bolster being generally curved in both the plane of sheet 11 and in the plane perpendicular to plane 11.

The width of sheet 11 is preferably 38.1 cm (15 inches) and the width B of each bolster 15 is 11.43 cm (4.5 inches).

A decorative fringe 21 is fastened to each of the opposed longitudinal ends 22 of the sheet 11.

While only one pair of bolsters 15 are required for the purpose of providing a suitable headrest, the placement of two pairs of bolsters 15, with each pair located on opposed longitudinal end sections 25 of sheet 11 provides weight balance when the device 10 is draped over the back 12 of a chair 13, with one pair of bolsters resting on the face side 28 of the chair back 12 and the other pair of bolsters hanging over the rear side of the chair back 12.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A pillow unit that may be draped over a chair back to serve as a headrest, comprising a flexible sheet fitted with a pair of padded bolster sections that project beyond a first side of aid sheet, with the opposed second side of said sheet being a generally flat surface with the sheet in a draped mode, in which the bolster sections are spaced apart by a distance that permits each bolster to contact the head of a user resting against both bolsters.

said sheet fitted with two pairs of said spaced bolster sections mounted on the said first side of the sheet so that each pair of bolster sections balance the other when the mid-section of the sheet is draped over the back of a chair, with each pair of bolster sections mounted at opposed end sections of the sheet, so that either pair of said bolster sections are alternately useable as head rests, dependent upon the orientation of the sheet when draped over the back of a chair.

* * * * *